US008277630B2

(12) United States Patent
Orihashi

(10) Patent No.: US 8,277,630 B2
(45) Date of Patent: Oct. 2, 2012

(54) TIN ELECTROPLATING SOLUTION AND A METHOD FOR TIN ELECTROPLATING

(75) Inventor: Masanori Orihashi, Ageo (JP)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 12/657,096

(22) Filed: Jan. 13, 2010

(65) Prior Publication Data

US 2011/0308960 A1 Dec. 22, 2011

(30) Foreign Application Priority Data

Jan. 16, 2009 (JP) ..... 2009-008262

(51) Int. Cl.
*C25D 3/60* (2006.01)
*C25D 3/32* (2006.01)
*C23C 16/40* (2006.01)

(52) U.S. Cl. ..... 205/302; 205/253; 205/303; 106/1.25

(58) Field of Classification Search ..... 205/253, 205/302, 303; 106/1.25
See application file for complete search history.

(56) References Cited

U.S. PATENT DOCUMENTS

| | | | | |
|---|---|---|---|---|
| 3,954,573 | A * | 5/1976 | Dahlgren et al. | 205/253 |
| 4,459,185 | A * | 7/1984 | Obata et al. | 205/254 |
| 5,110,423 | A * | 5/1992 | Little et al. | 205/254 |
| 2004/0251143 | A1 * | 12/2004 | Kazuyuki et al. | 205/302 |

* cited by examiner

*Primary Examiner* — Edna Wong

(74) *Attorney, Agent, or Firm* — John J. Piskorski

(57) ABSTRACT

A tin plating solution and tin plating method for chip components minimizes tin shavings when plated components are rubbed together such as during bulk mounting. This minimizes sticking of the chip components together.

5 Claims, 4 Drawing Sheets

TIN ELECTROPLATING SOLUTION AND A METHOD FOR TIN ELECTROPLATING

The present invention relates to an electrolytic tin plating solution and electrolytic tin plating method, and in further detail relates to an electrolytic tin plating solution and electrolytic tin plating method for chip components that is useful for plating chip components such as ceramic capacitors, and the like.

Chip components are becoming smaller each year, and in recent years there has been a shift in that mounting forms that are used in bulk mounting systems have become mainstream. Bulk mounting systems are efficient mounting systems where the packaging material that is used has been reevaluated, from when chip components are supplied until mounted. A bulk case (chip component packaging material for a bulk mounting system) is used as the packaging form, and a bulk feeder is used which has a function that aligns the chip components which are randomly oriented and supplies the chip components to the chip mounter. The bulk feeder is a device that aligns the randomly oriented components that are packaged in a bulk case, and supplies the components to a mounter, and the bulk feeder can use an air system, a hopper system, or a rotating drum system, or the like.

The chip components are plated with a metal such as tin or tin alloy in order to provide solderability to the electrode area. However, when chips that have been plated using a conventional tin plating solution are used in a bulk mounter, tin powder from the tin plating film will be generated during bulk mounting, and problems will occur in the device. As a countermeasure, there is demand for a tin plating solution where the tin film produces fewer shavings.

JP2002-47593 discloses a tin plating bath with a pH between 3 and 10 containing stannous salt; at least one type of complexing agent selected from the group consisting of citric acid, gluconic acid, pyrophosphoric acid, salts thereof, or gluconolactone; an aromatic aldehyde; and an aliphatic aldehyde; wherein a polyethylene polyoxypropylene glycol-based surfactant is added as a nonionic surfactant to the tin plating solution. However, when the plating solution of JP2002-47593 is used, tin shavings are generated and problems will occur when bulk mounting, as will be shown in the comparative example.

Furthermore, tin plating of chip components is often performed using barrel plating, but during plating there is a problem that the chip components will be coupled together and so-called "sticking" will occur. When sticking occurs, plating defects are produced, and therefore there is demand for a plating solution that minimizes "sticking." Furthermore, throwing power to low current regions and solder wettability are also properties that are required of plating solutions for chip components.

Therefore, an objective of the present invention is to provide an electrolytic tin plating solution and an electrolytic tin plating method for chip components that can provide a tin plating film that minimizes tin shavings when plated components are rubbed together such as during bulk mounting, and that minimizes sticking of the chip components together, while other plating characteristics are favorable.

As a result of the diligent research to achieve the aforementioned objectives, the present inventors have discovered that the aforementioned problems can be resolved by using two specific types of nonionic surfactants as the surfactant, and thus the present invention was achieved.

In other words, the present invention provides an electrolytic tin plating solution for chip components containing (1) stannous ions, (2) a complexing agent, (3) a nonionic surfactant, and (4) an antioxidant; wherein the nonionic surfactant contains a compound expressed by the following General Formula (A) and a compound expressed by the following General Formula (B).

$$R—(C_6H_4)—RO(CH_2CH_2O)_nH \quad \text{General Formula (A)}$$

where R represents a straight or branched alkyl group with between 1 and 20 carbon atoms, and n represents an integer between 1 and 10.

$$HO—(C_2H_4O)_l—(C_3H_6O)_m—(C_2H_4O)_n—H \quad \text{General Formula (B)}$$

where l represents an integer between 1 and 10, m represents an integer between 1 and 10, and n represents an integer between 1 and 10.

In one aspect of the present invention, the concentration of the compound expressed by the aforementioned General Formula (A) and the concentration of the compound expressed by the aforementioned General Formula (B) in the tin plating solution is 0.05 g/L or higher and less than 2 g/L. Furthermore, in one aspect of the present invention, the aforementioned complexing agent is sodium gluconate. Furthermore, in one aspect of the present invention, the aforementioned antioxidant is a salt of hydroquinone sulfonic acid.

Furthermore, the present invention provides a tin plating method for chip components where electrolytic tin plating is performed using the aforementioned electrolytic tin plating solution.

The plating solution of the present invention can provide a tin plating film that minimizes tin shavings when chip components are rubbed together, and that minimizes sticking of the chip components together, while other characteristics of the tin plating film are favorable. Therefore, the chip components that are plated using the tin plating solution of the present invention can be favorably mounted without generating tin shavings even when bulk mounting is used.

Figure 1:
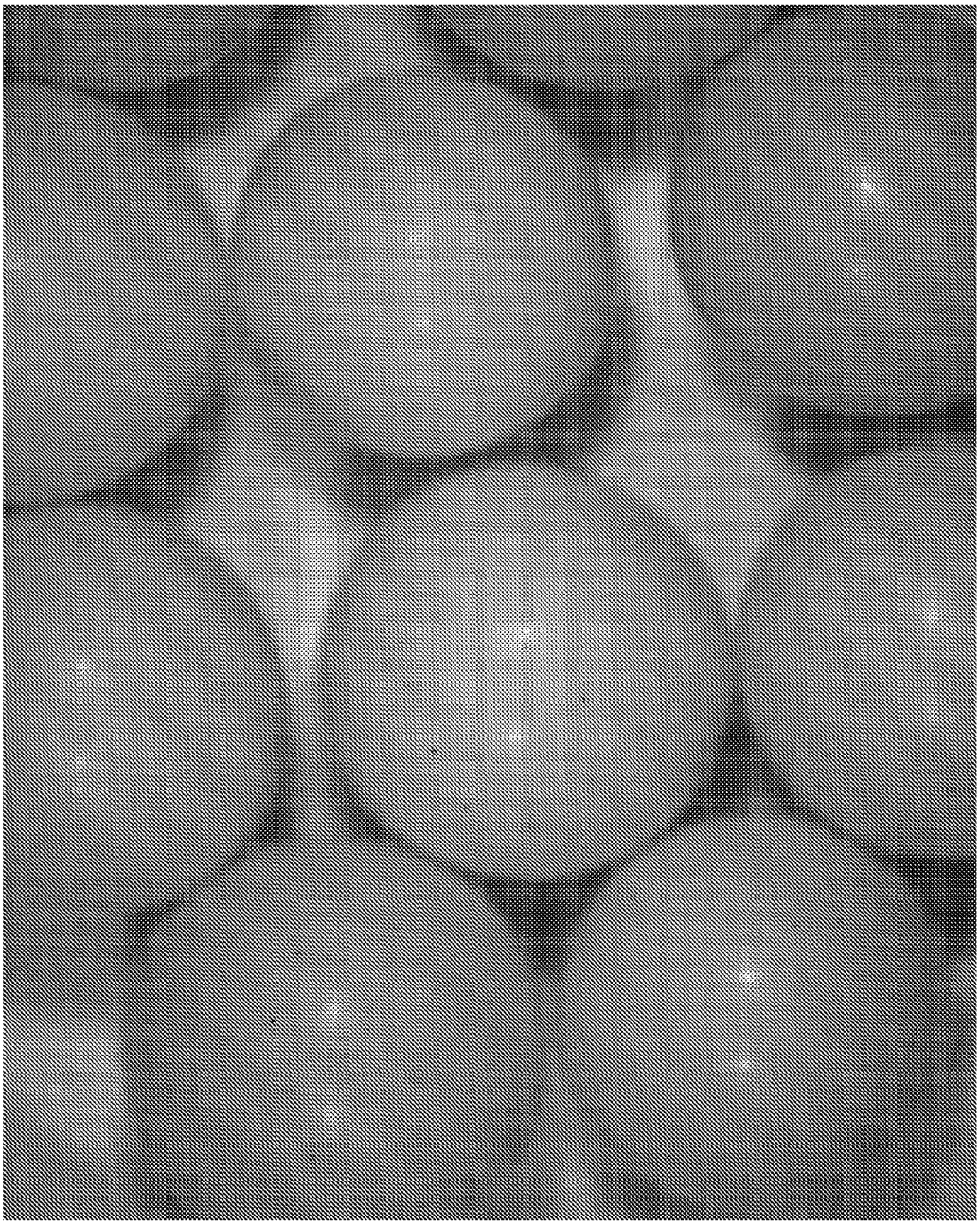
FIG. 1 is a microphotograph of a ceramic ball with an evaluation number of 3.

The abbreviations used throughout this specification have the following meaning unless otherwise designated: g=gram; mg=milligram; ° C.=degrees Celsius; min=minute; m=meter; cm=centimeter; L=liter; mL=milliliter; A=Ampere; $dm^2$=square decimeter. The range of all values includes the boundary values and may be combined in any order. The terms "plating solution" and "plating bath" used throughout this specification are used interchangeably and have the same meaning.

The electrolytic tin plating solution of the present invention provides an electrolytic tin plating solution for chip components containing (1) stannous ions, (2) a complexing agent, (3) a nonionic surfactant, and (4) an antioxidant; wherein the nonionic surfactant contains a compound expressed by the following General Formula (A) and a compound expressed by the following General Formula (B).

$$R—(C_6H_4)—RO(CH_2CH_2O)_nH \quad \text{General Formula (A)}$$

where R represents a straight or branched alkyl group with between 1 and 20 carbon atoms, and n represents an integer between 1 and 10.

$$HO—(C_2H_4O)_l—(C_3H_6O)_m—(C_2H_4O)_n—H \quad \text{General Formula (B)}$$

where l represents an integer between 1 and 10, m represents an integer between 1 and 10, and n represents an integer between 1 and 10.

As described above, the plating solution of the present invention contains the aforementioned two specific types of nonionic surfactants. The present inventors evaluated various types of nonionic surfactants and discovered that a plating film that minimizes tin shavings while other plating characteristics are favorable can be provided by using both the nonionic surfactant expressed by General Formula (A) and the nonionic surfactant expressed by General Formula (B), which are the aforementioned specific nonionic surfactants. The nonionic surfactant expressed by General Formula (A) is a polyoxyethylene alkylphenyl ether-based surfactant. In this formula, R represents a straight or branched alkyl group with between 1 and 20 carbon atoms. The nonionic surfactant expressed by General Formula (A) can be a commercial product, and examples include Nonal 214 produced by Toho Chemical Co., Ltd., SYNFAC 8025U produced by Milliken Chemicals, and Adekatol PC-8 produced by ADEKA Corporation, and the like, and the amount of nonionic surfactant expressed by General Formula (A) that is used is preferably 0.05 g/L or higher and less than 2 g/L. If the amount used exceeds 2 g/L, the ratio of sticking will increase, which is not favorable.

The nonionic surfactant expressed by General Formula (B) is a polyoxyethylene polyoxypropylene glycol-based surfactant. Note that l represents an integer between 1 and 10, m represents an integer between 1 and 10, and n represents an integer between 1 and 10. The nonionic surfactant expressed by General Formula (B) can be a commercial product, and examples include Adeka Pluronic L-64 and Adeka Pluronic L-44, and the like, manufactured by ADEKA Corporation. The amount of nonionic surfactant expressed by General Formula (B) that is used is preferably 0.5 g/L or higher and less than 2 g/L.

The ratio between the amount of nonionic surfactant expressed by General Formula (A) and the amount of nonionic surfactant expressed by General Formula (B) is preferably between 1:20 and 20:1, more preferably between 1:10 and 10:1.

The plating bath of the present invention contains stannous ions as an essential composition element. Stannous ions are bivalent tin ions. Any compound that can provide stannous ions into the plating bath can be used. Generally, tin salts of inorganic acids and organic acids are preferably used in the plating solution. Examples of tin salts of inorganic acids include the stannous salts of sulfuric acid or hydrochloric acid, and the tin salts of organic acids include the stannous salts of substituted or unsubstituted alkane sulfonic acids and alkanol sulfonic acids, such as methanesulfonic acid, ethanesulfonic acid, propanesulfonic acid, 2-hydroxy-ethyl-1-sulfonic acid, 2-hydroxypropane-1-sulfonic acid and 1-hydroxypropane-2-sulfonic acid, and the like. A particularly preferable source of stannous ions is stannous sulfate for salts of inorganic acids and stannous methanesulfonate for salts of organic acids. The compounds that can provide these ions can be used individually, or as a combination of two or more.

The amount of stannous ions in the plating bath is, for example, between 1 g/L and 150 g/L, preferably between 5 g/L and 50 g/L, and more preferably between 8 g/L and 20 g/L of tin ion, calculated as tin ions.

The complexing agent can be any complexing agent without restriction so long as the pH of the plating solution can be adjusted to be between 3 and 10. Specific examples include gluconic acid, gluconate salt, citric acid, citrate salt, pyrophosphoric acid, and pyrophosphate salt, and the like. Of these, sodium gluconate and citric acid are preferable for the present invention.

The amount of complexing agent in the plating bath solution is preferably greater than the stoichiometric quantity of bivalent tin ion present in the plating bath. For example, the amount of complexing agent in the plating bath is between 10 and 500 g/L, preferably between 30 and 300 g/L, and more preferably between 50 and 200 g/L.

The plating solution of the present invention contains an antioxidant. The antioxidant is used to prevent oxidation from bivalent tin to quadrivalent tin, and for instance, hydroquinone, catechol, resorcin, phloroglucin, pyrogallol, hydroquinonesulfonic acid, and salts thereof can be used.

An appropriate concentration of antioxidant in the plating bath is, for instance, 10 mg/L or more and 100 g/L or less, preferably 100 mg/L or more and 50 g/L or less, and more preferably 0.5 g/L or more and 5 g/L or less.

Furthermore, if necessary, commonly known additives such as glossing agents, smoothing agents, conduction agents, anode dissolving agents, or the like, may also be added to the plating bath of the present invention.

The order of adding the various components when preparing the plating bath is not particularly restricted, but from the perspective of stability, water is added first, followed by the acid, and after thoroughly mixing, the tin salt is added, and after thoroughly dissolving, the other required chemicals are added in order.

Examples of the chip components that are plated with the plating solution of the present invention include electronic components such as passive components like resistors, capacitors, inductors (inductor transformers), variable resistors, and variable capacitors, functional components like quartz crystal oscillators, LC filters, ceramic filters, delay lines, and SAW filters, and connecting components like switches, connectors, relay fuses, optical connecting components, and printed wiring boards, and the like.

The method of electrolytic plating using the plating solution of the present invention can be any commonly known plating method such as barrel plating, throw-through plater plating, and the like. The concentration on each of the aforementioned components (1) through (4) of the plating solution can be arbitrarily selected based on the aforementioned information for each component.

The electroplating method which uses the plating solution of the present invention may be performed at a plating bath temperature of between 10° C. and 50° C., preferably between 15° C. and 30° C. Furthermore, the cathode current density is appropriately selected from a range of, for instance, 0.01 and 5 A/dm$^2$, preferably between 0.05 and 3 A/dm$^2$. During the plating process, the plating bath may be left unstirred, or a method such as stirring with a stirrer, or the like, or circulating with a pump, or the like, can be used.

EMBODIMENTS 1 THROUGH 12

A solution with the following composition was prepared as the essential bath.

(A) stannous methanesulfonate (as tin ion): 15 g/L (B) methanesulfonic acid (as free acid): 115 g/L (C) sodium gluconate: 125 g/L
(D) potassium hydroquinone sulfonate: 2 g/L
(E) sodium hydroxide (pH adjusting agent): 4.0 g/L
(F) distilled water: remainder The various non-ionic surfactants shown in the following Table 1 were added to the essential bath at the concentration shown in Table 2, to prepare the tin plating solutions of Embodiments 1 through 12. A Hull cell test was performed at the following conditions using 1 L of each tin plating solution, and the appearance was evaluated. The results are shown in Table 2.

Hull Cell Test Conditions:
Current density: 0.2 A
Time: 10 minutes
Mixing: 4 m/min
Bath temperature: 30° C.
pH: 4.0

TABLE 1

| Surfactant Type | Surfactant |
|---|---|
| 1 | Hydroxyethyl cellulose |
| 2 | Polyoxyethylene lauryl alcohol |
| 3 | Polyoxyethylene alkylphenyl ether (Adekatol PC-8 manufactured by ADEKA Corporation) |
| 4 | Polyoxyethylene poly oxypropylene glycol (Adeka Pluronic L-64 manufactured by ADEKA Corporation) |
| 5 | Fatty acid polyoxyethylene glycol (PEG-600) |
| 6 | Fatty acid alkanolamide-based surfactant (Adeka Pluronic TR-704 manufactured by ADEKA Corporation) |

TABLE 2

| | | | Appearance | | | | |
|---|---|---|---|---|---|---|---|
| Embodiment | Surfactant | Quantity | Fine gloss | Whiteness | Gray | No adhesion | Uniformity |
| 1 | 1 | 0.5 g/L | — | — | 8 cm | 2 cm | Overall nonuniform |
| 2 | 2 | 0.5 g/L | — | 3 cm | 6 cm | 1 cm | Partially nonuniform |
| 3 | 3 | 0.5 g/L | 10 cm | — | — | — | Partially nonuniform |
| 4 | 4 | 0.5 g/L | 5.5 cm | 3.5 cm | 1 cm | — | Partially nonuniform |
| 5 | 5 | 0.5 g/L | — | — | 9 cm | 1 cm | Overall nonuniform |
| 6 | 6 | 0.5 g/L | 10 cm | — | — | — | Uniform appearance |
| 7 | 2 | 0.5 g/L | 10 cm | — | — | — | Uniform appearance |
| | 3 | 0.5 g/L | | | | | |
| 8 | 2 | 0.5 g/L | 6 cm | 1 cm | 3 cm | — | Partially nonuniform |
| | 4 | 0.5 g/L | | | | | |
| 9 | 2 | 0.5 g/L | 10 cm | — | — | — | Uniform appearance |
| | 6 | 0.5 g/L | | | | | |
| 10 | 3 | 0.5 g/L | 10 cm | — | — | — | Uniform appearance |
| | 4 | 0.5 g/L | | | | | |
| 11 | 3 | 0.5 g/L | 10 cm | — | — | — | Uniform appearance |
| | 6 | 0.5 g/L | | | | | |
| 12 | 4 | 0.5 g/L | 10 cm | — | — | — | Partially nonuniform |
| | 6 | 0.5 g/L | | | | | |

Furthermore, the tin film thickness was measured using a fluorescent x-ray minute thickness meter in a total of nine locations beginning 1 cm from the left and 1 cm from the bottom moving right at 1 cm intervals on a Hull cell panel that had been Hull cell tested. The film thickness distribution results are shown in Table 3.

TABLE 3

| | Surfactant | Tin Plating Film Thickness Distribution (micrometers) | | | | | | | | |
|---|---|---|---|---|---|---|---|---|---|---|
| Embodiment | used | 1 | 2 | 3 | 4 | 5 | 6 | 7 | 8 | 9 |
| 1 | 1 | 4.52 | 3.75 | 2.77 | 2.04 | 1.70 | 1.27 | 0.94 | 0.48 | 0.32 |
| 2 | 2 | 1.93 | 2.64 | 3.45 | 2.39 | 1.72 | 1.26 | 0.90 | 0.59 | 0.35 |
| 3 | 3 | 2.03 | 2.02 | 1.90 | 1.56 | 1.38 | 1.15 | 0.93 | 0.73 | 0.63 |
| 4 | 4 | 1.89 | 1.75 | 1.50 | 1.27 | 1.20 | 1.46 | 1.61 | 1.19 | 1.09 |
| 5 | 5 | 3.77 | 2.96 | 2.34 | 1.82 | 1.40 | 1.03 | 0.68 | 0.47 | 0.27 |
| 6 | 6 | 1.28 | 1.05 | 0.81 | 0.65 | 0.47 | 0.39 | 0.28 | 0.31 | 0.24 |
| 7 | 2 | 2.59 | 2.51 | 2.08 | 1.69 | 1.33 | 1.10 | 0.91 | 0.79 | 0.75 |
| | 3 | | | | | | | | | |
| 8 | 2 | 1.74 | 1.61 | 1.47 | 1.10 | 0.91 | 1.70 | 2.77 | 1.45 | 0.57 |
| | 4 | | | | | | | | | |
| 9 | 2 | 2.35 | 1.88 | 1.52 | 1.36 | 1.18 | 0.97 | 0.82 | 0.67 | 0.51 |
| | 6 | | | | | | | | | |
| 10 | 3 | 1.98 | 1.77 | 1.65 | 1.50 | 1.37 | 1.30 | 1.10 | 0.86 | 0.74 |
| | 4 | | | | | | | | | |
| 11 | 3 | 2.33 | 1.87 | 1.43 | 1.35 | 1.10 | 0.91 | 0.79 | 0.54 | 0.51 |
| | 6 | | | | | | | | | |
| 12 | 4 | 1.27 | 1.01 | 1.05 | 0.92 | 0.77 | 0.67 | 0.53 | 0.43 | 0.37 |
| | 6 | | | | | | | | | |

EMBODIMENTS 13 THROUGH 20

Tin-Film Shaving Test

The various nonionic surfactants were added to the same essential bath as was used in the aforementioned Embodiments 1 through 12 at the ratios shown in the following Table 4 to prepare tin plating solutions for Embodiments 13 through 20. Furthermore, a conventional tin plating bath for chip components was used for comparison.

TABLE 4

Samples for Tin Shavings Generating Test

| Embodiment | Surfactant | Amount added |
|---|---|---|
| 13 | 2 | 0.5 g/L |
| 14 | 3 | 0.5 g/L |
| 15 | 4 | 0.5 g/L |
| 16 | 2 | 0.5 g/L |
| | 3 | 0.5 g/L |
| 17 | 2 | 0.5 g/L |
| | 4 | 0.5 g/L |
| 18 | 2 | 0.5 g/L |
| | 6 | 0.5 g/L |
| 19 | 3 | 0.5 g/L |
| | 4 | 0.5 g/L |
| 20 | 3 | 0.5 g/L |
| | 6 | 0.5 g/L |

The reference numbers for the surfactants shown in the table refer to the numbers for the surfactants shown in Table 1.

Test Methods

Tin plating was performed in accordance with the plating conditions and plating process shown below, for each of the plating solutions containing the various surfactants. After plating, a rotating test was performed to evaluate the ease of forming shavings from the tin film.

Plating Conditions:

Current density: 0.2 ASD

Time: 40 minutes

Concentration of tin in the plating solution (as tin ions): 15 g/L pH: 4

Temperature: 30° C.

Base layer nickel thickness: 2 μm

Tin plating thickness: 6 μm (4 to 8 μm)

Object for plating (chip resistor, size 1608): 5 g/barrel

Dummy ball (SS-80S manufactured by IKK Shot Co., Ltd.) 200 g/barrel

Barrel device: Mini-barrel Model 1-B (Yamamoto MS Co., Ltd.)

Rotational speed: 10 rpm

TABLE 5

Plating Process

| | Process | Conditions |
|---|---|---|
| 1 | Water wash | 3 minutes |
| 2 | Nickel plating | 55° C. 0.16 ASD × 30 minutes |
| 3 | Water wash | 1 minute |
| 4 | Water wash | 2 minutes |
| 5 | Tin plating | 30° C. 0.2 ASD × 40 minutes |
| 6 | Water wash | 1 minute |
| 7 | Water wash | 5 minutes |
| 8 | Drying | |

The rotation test method is to perform the rotation test in accordance with the rotation test conditions using a mixed rotor variable VMR-3R rotation device manufactured by As One Corporation.

Rotation Test Conditions

Rotational speed: 100 rpm

Time: 3 hours

Rotation test sample: Tin-plated chip components mixed with 4 mm diameter ceramic balls in a 30 mL screw tube.

Ceramic balls: 40 g

Plated chip resistors (1608): 1 g

Figure 2:
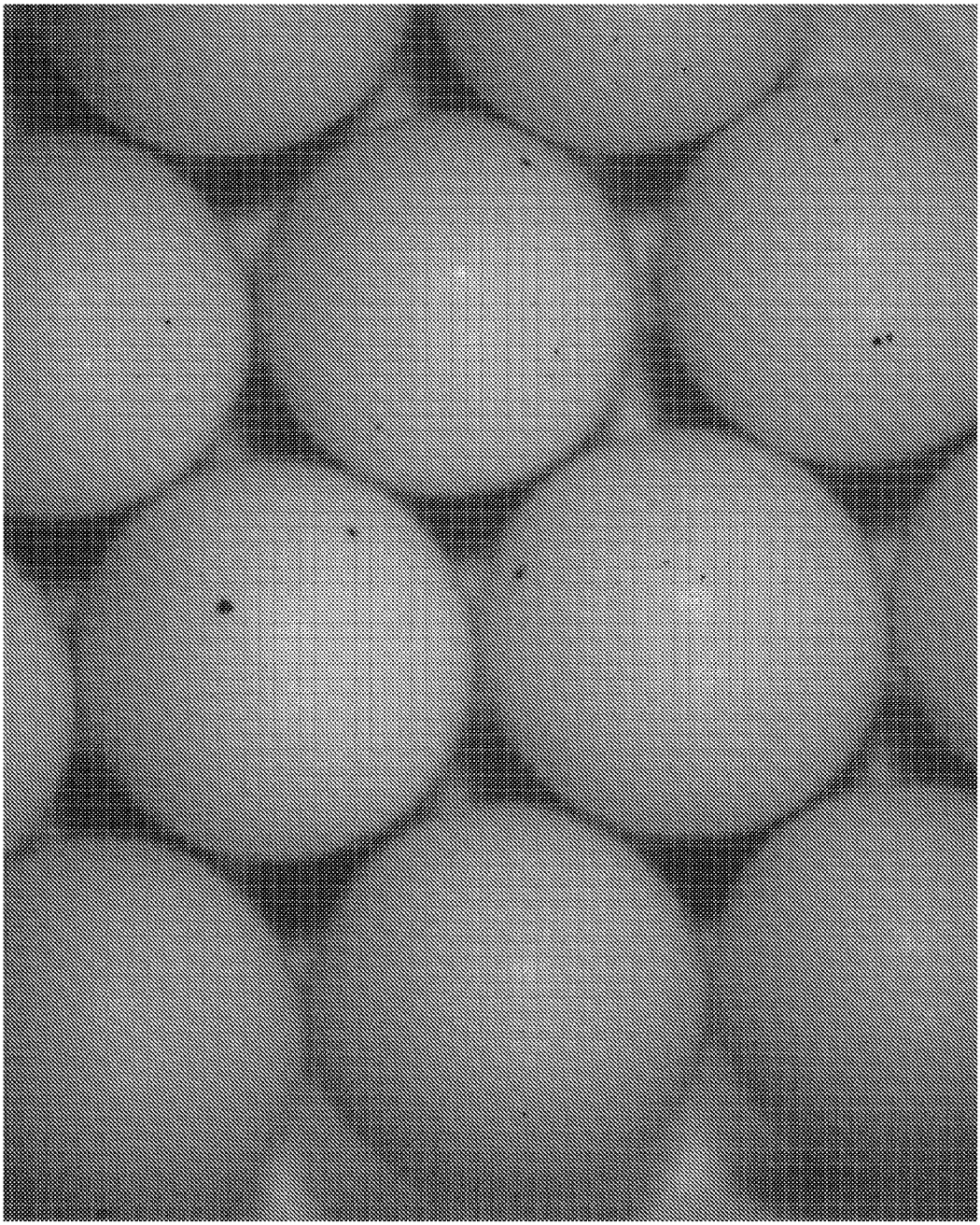
FIG. 2 is a microphotograph of a ceramic ball with an evaluation number of 2.
Figure 3:
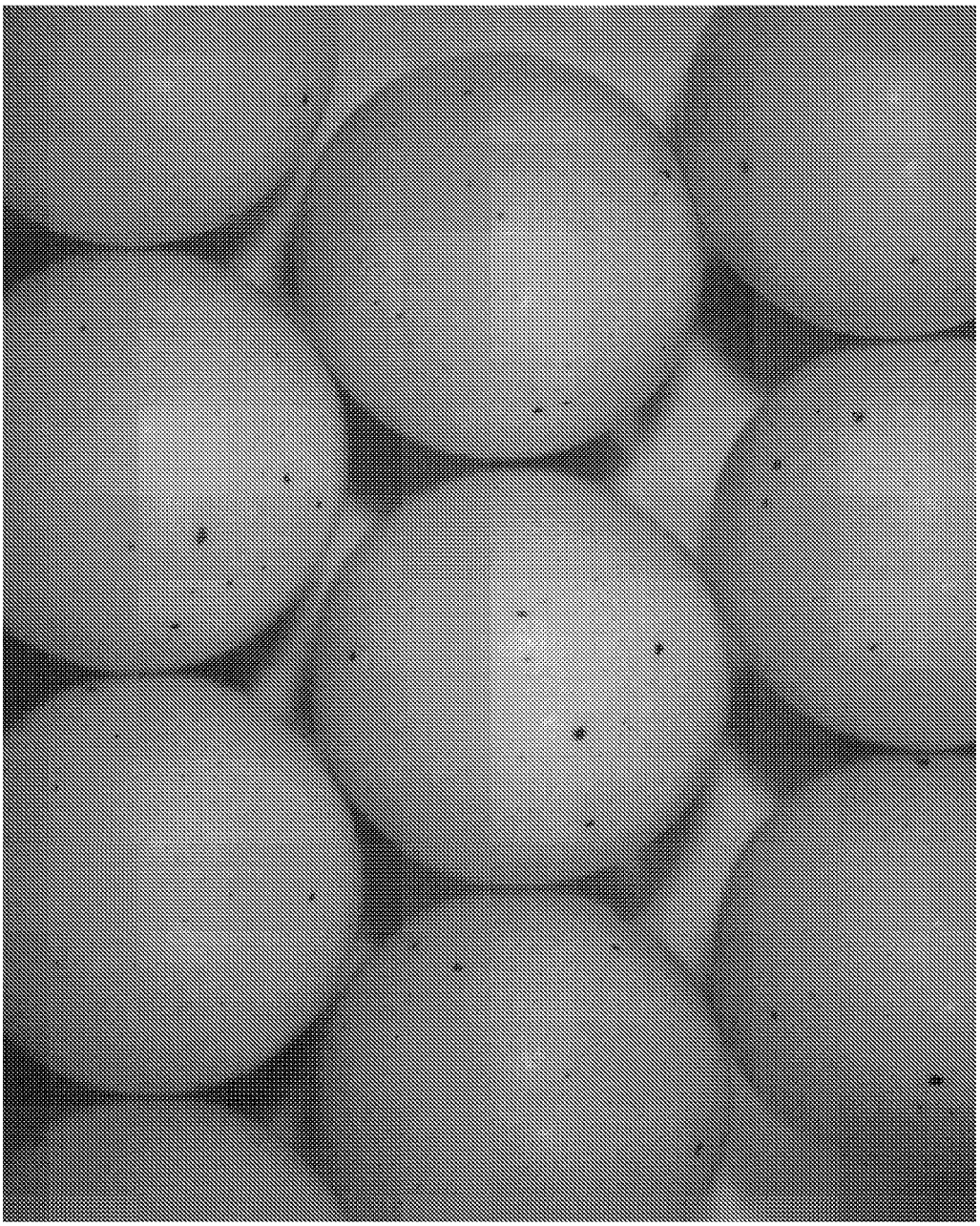
FIG. 3 is a microphotograph of a ceramic ball with an evaluation number of 1.
Figure 4:
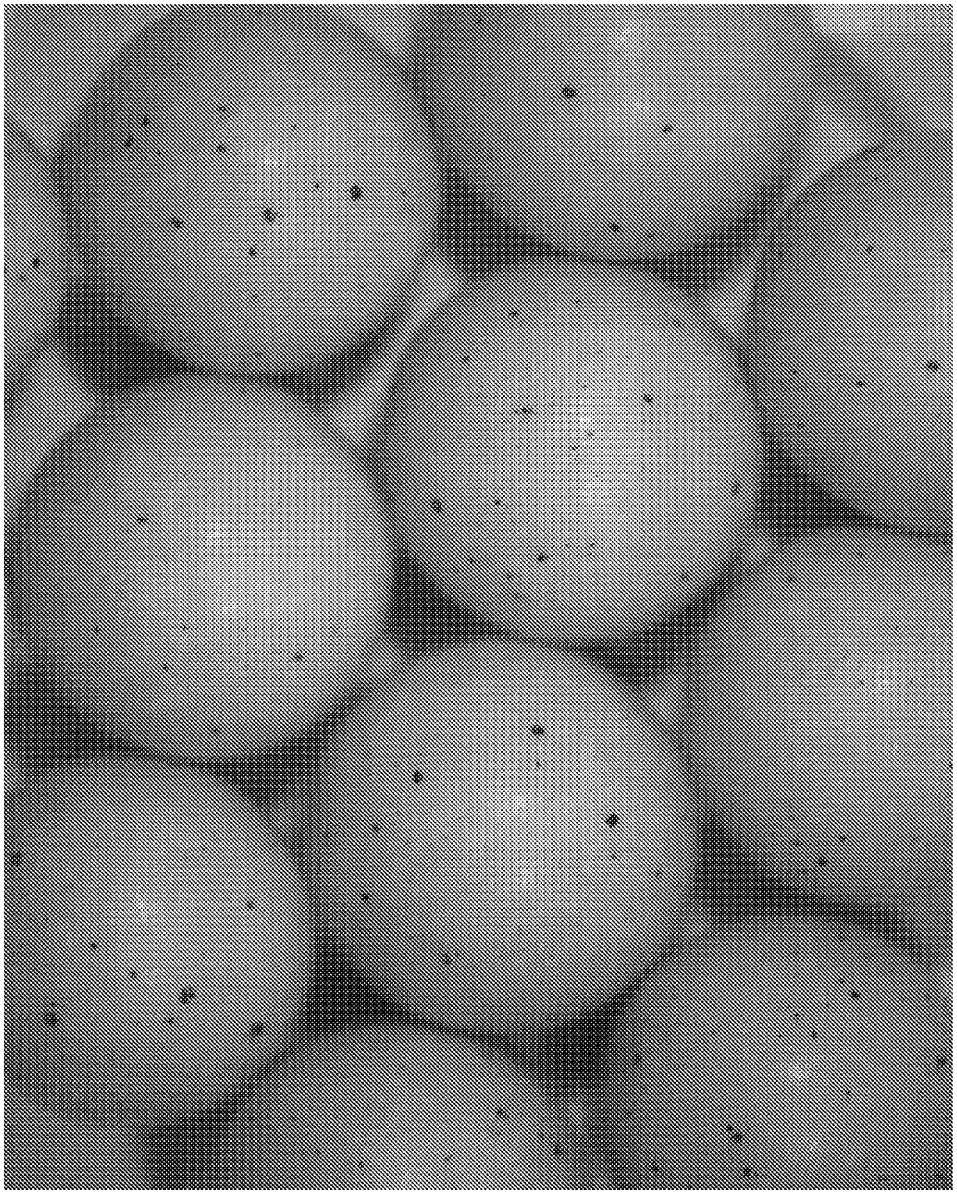
FIG. 4 is a microphotograph of a ceramic ball with an evaluation number of 0.

After rotation testing, the ceramic balls with tin shavings attached were observed under a microscope to determine the level of tin that had adhered. Furthermore, the tin shavings which had adhered to the surface were dissolved in 30% aqua regalis and quantitative analysis for tin was performed by the atomic absorption method, and the amount of tin (mg) that had adhered per unit surface area ($m^2$) of the ceramic balls was calculated and compared. A ranking was applied where samples where tin shavings did not adhere to the surface of the ceramic balls (amount of tin was less than 30 $mg/m^2$) were evaluated as 3, samples where the tin shavings were minimal (tin was 30 $mg/m^2$ or higher but less than 50 $mg/m^2$) were evaluated as 2, samples with significant quantities of shavings (tin was 50 $mg/m^2$ or higher but less than 100 $mg/m^2$) were evaluated as 1, and samples with many shavings (tin is higher than 100 $mg/m^2$) were evaluated as 0. Microphotographs of the ceramic balls with evaluation numbers between 3 and 0 are shown in FIG. 1 through FIG. 4.

The rotation test results are shown in the following Table 6.

TABLE 6

Rotation Test Results

| Embodiment | Surfactant | Evaluation number | Amount of tin shavings |
|---|---|---|---|
| 13 | 2 | 1 | 57.73 $mg/m^2$ |
| 14 | 3 | 1 | 71.66 $mg/m^2$ |
| 15 | 4 | 1 | 58.75 $mg/m^2$ |
| 16 | 2 | 2 | 49.1 $mg/m^2$ |
| | 3 | | |
| 17 | 2 | 2 | 48.1 $mg/m^2$ |
| | 4 | | |
| 18 | 2 | 1 | 89.57 $mg/m^2$ |
| | 6 | | |
| 19 | 3 | 3 | 29.19 $mg/m^2$ |
| | 4 | | |
| 20 | 3 | 1 | 52.42 $mg/m^2$ |
| | 6 | | |
| Conventional bath | | 1 | 60.9 $mg/m^2$ |

The rotation test results confirmed that the tin plating film would generate the least amount of tin shavings if a combination of surfactant 3 (polyoxyethylene alkylphenyl ether) and surfactant 4 (polyoxyethylene polyoxypropylene glycol) were used.

EMBODIMENTS 21 THROUGH 29

The tin plating solutions for Embodiments 21 through 29 were prepared by adding the various surfactants at the concentrations shown in Table 7 to the same essential baths as was used for the aforementioned Embodiments 1 through 12, and the appearance and film thickness distribution of the plating film were evaluated in the same manner as Embodiments 1 through 12. The results are shown in Table 8 and Table 9.

TABLE 7

| Embodiment | Surfactant | Concentration |
|---|---|---|
| 21 | 3 | 2 g/L |
| | 4 | 0.05 g/L |
| 22 | 3 | 1 g/L |
| | 4 | 0.05 g/L |
| 23 | 3 | 0.5 g/L |
| | 4 | 0.05 g/L |

TABLE 7-continued

| Embodiment | Surfactant | Concentration |
|---|---|---|
| 24 | 3 | 0.05 g/L |
| | 4 | 0.05 g/L |
| 25 | 3 | 0.05 g/L |
| | 4 | 0.5 g/L |
| 26 | 3 | 0.05 g/L |
| | 4 | 1 g/L |
| 27 | 3 | 0.05 g/L |
| | 4 | 2 g/L |
| 28 | 3 | 1 g/L |
| | 4 | 0 g/L |
| 29 | 3 | 0 g/L |
| | 4 | 1 g/L |

TABLE 8

Hull Cell Appearance

| | | | Appearance | | | | |
|---|---|---|---|---|---|---|---|
| Embodiment | Surfactant | Concentration | Fine gloss | Whiteness | Gray | No adhesion | Uniformity |
| 21 | 3 | 2 g/L | 10 cm | — | — | — | Uniform appearance |
| | 4 | 0.05 g/L | | | | | |
| 22 | 3 | 1 g/L | 10 cm | — | — | — | Uniform appearance |
| | 4 | 0.05 g/L | | | | | |
| 23 | 3 | 0.5 g/L | 10 cm | — | — | — | Uniform appearance |
| | 4 | 0.05 g/L | | | | | |
| 24 | 3 | 0.05 g/L | 10 cm | — | — | — | Uniform appearance |
| | 4 | 0.05 g/L | | | | | |
| 25 | 3 | 0.05 g/L | 9 cm | 1 cm | — | — | Uniform appearance |
| | 4 | 0.5 g/L | | | | | |
| 26 | 3 | 0.05 g/L | 9 cm | — | 1 cm | — | Uniform appearance |
| | 4 | 1 g/L | | | | | |
| 27 | 3 | 0.05 g/L | 7 cm | 2 cm | 1 cm | — | Partially nonuniform |
| | 4 | 2 g/L | | | | | |
| 28 | 3 | 1 g/L | 10 cm | — | — | — | Uniform appearance |
| | 4 | 0 g/L | | | | | |
| 29 | 3 | 0 g/L | 5 cm | 3 cm | 2 cm | — | Partially nonuniform |
| | 4 | 1 g/L | | | | | |

TABLE 9

Film Thickness Distribution using Hull Cell Test

| Surfactant | | | Tin Plating Film Thickness Distribution (micrometers) | | | | | | | | |
|---|---|---|---|---|---|---|---|---|---|---|---|
| Embodiment | used | Concentration | 1 | 2 | 3 | 4 | 5 | 6 | 7 | 8 | 9 |
| 21 | 3 | 2 g/L | 2.16 | 1.98 | 1.82 | 1.56 | 1.36 | 1.14 | 0.92 | 0.70 | 0.59 |
| | 4 | 0.05 g/L | | | | | | | | | |
| 22 | 3 | 1 g/L | 1.95 | 1.88 | 1.70 | 1.52 | 1.25 | 1.07 | 0.82 | 0.65 | 0.49 |
| | 4 | 0.05 g/L | | | | | | | | | |
| 23 | 3 | 0.5 g/L | 2.12 | 1.91 | 1.80 | 1.58 | 1.29 | 1.12 | 0.89 | 0.76 | 0.58 |
| | 4 | 0.05 g/L | | | | | | | | | |
| 24 | 3 | 0.05 g/L | 1.98 | 1.77 | 1.65 | 1.50 | 1.37 | 1.30 | 1.10 | 0.86 | 0.74 |
| | 4 | 0.05 g/L | | | | | | | | | |
| 25 | 3 | 0.05 g/L | 1.99 | 1.69 | 1.42 | 1.29 | 1.15 | 1.12 | 0.99 | 0.99 | 1.07 |
| | 4 | 0.5 g/L | | | | | | | | | |
| 26 | 3 | 0.05 g/L | 1.80 | 1.59 | 1.30 | 1.16 | 1.05 | 1.13 | 1.20 | 1.15 | 1.45 |
| | 4 | 1 g/L | | | | | | | | | |
| 27 | 3 | 0.05 g/L | 1.94 | 1.64 | 1.35 | 1.17 | 1.06 | 1.01 | 1.03 | 0.66 | 1.84 |
| | 4 | 2 g/L | | | | | | | | | |
| 28 | 3 | 1 g/L | 2.03 | 1.86 | 1.71 | 1.46 | 1.27 | 1.10 | 0.89 | 0.66 | 0.54 |
| | 4 | 0 g/L | | | | | | | | | |
| 29 | 3 | 0 g/L | 1.81 | 1.55 | 1.28 | 1.20 | 1.02 | 1.58 | 1.93 | 1.28 | 1.01 |
| | 4 | 1 g/L | | | | | | | | | |

Furthermore, a rotation test was performed in a manner similar to Embodiments 13 through 19 using the plating solutions of Embodiments 21 through 29 in order to determine the ease of generating tin shavings. Furthermore, the degree of sticking of the samples after tin plating was also confirmed. Confirmation of sticking was performed by calculating the ratio of chip components that had stuck together from the total number of chip components. The results for the rotation test and the sticking confirmation are shown in the following Table 10.

TABLE 10

Tin Shavings and Confirmation of Sticking

| Embodiment | Surfactant used | Concentration | Amount of tin shavings | Evaluation number | Sticking ratio |
|---|---|---|---|---|---|
| 21 | 3 | 2 g/L | 37.15 mg/m$^2$ | 2 | 30.7% |
| | 4 | 0.05 g/L | | | |
| 22 | 3 | 1 g/L | 29.92 mg/m$^2$ | 3 | 8.7% |
| | 4 | 0.05 g/L | | | |
| 23 | 3 | 0.5 g/L | 28.98 mg/m$^2$ | 3 | 5.3% |
| | 4 | 0.05 g/L | | | |
| 24 | 3 | 0.05 g/L | 26.19 mg/m$^2$ | 3 | 0.7% |
| | 4 | 0.05 g/L | | | |
| 25 | 3 | 0.05 g/L | 29.29 mg/m$^2$ | 3 | 0.7% |
| | 4 | 0.5 g/L | | | |
| 26 | 3 | 0.05 g/L | 29.21 mg/m$^2$ | 3 | 0.8% |
| | 4 | 1 g/L | | | |
| 27 | 3 | 0.05 g/L | 50.62 mg/m$^2$ | 1 | 1.0% |
| | 4 | 2 g/L | | | |
| 28 | 3 | 1 g/L | 50.82 mg/m$^2$ | 1 | 17.9% |
| | 4 | 0 g/L | | | |
| 29 | 3 | 0 g/L | 70.61 mg/m$^2$ | 1 | 0.8% |
| | 4 | 1 g/L | | | |

The following Table 11 was created by summarizing the evaluation results of Embodiments 21 through 29.

TABLE 11

| Embodiment | Surfactant used | Concentration | Appearance | Throwing power | Sticking | Amount of Tin shavings | Evaluation |
|---|---|---|---|---|---|---|---|
| 21 | 3 | 2 g/L | ○ | Δ | X | Δ | NG |
| | 4 | 0.05 g/L | | | | | |
| 22 | 3 | 1 g/L | ○ | Δ | Δ | ○ | OK |
| | 4 | 0.05 g/L | | | | | |
| 23 | 3 | 0.5 g/L | ○ | Δ | Δ | ○ | OK |
| | 4 | 0.05 g/L | | | | | |
| 24 | 3 | 0.05 g/L | ○ | ○ | ○ | ○ | OK |
| | 4 | 0.05 g/L | | | | | |
| 25 | 3 | 0.05 g/L | ○ | ○ | ○ | ○ | OK |
| | 4 | 0.5 g/L | | | | | |
| 26 | 3 | 0.05 g/L | ○ | ○ | ○ | ○ | OK |
| | 4 | 1 g/L | | | | | |
| 27 | 3 | 0.05 g/L | Δ | ○ | ○ | X | NG |
| | 4 | 2 g/L | | | | | |
| 28 | 3 | 1 g/L | ○ | Δ | X | X | NG |
| | 4 | 0 g/L | | | | | |
| 29 | 3 | 0 g/L | X | ○ | ○ | X | NG |
| | 4 | 1 g/L | | | | | |

What is claimed is:

1. An electrolytic tin plating solution for chip components, comprising:

(1) stannous ions;

(2) a complexing agent;

(3) a nonionic surfactant; and (4) an antioxidant;

wherein the nonionic surfactant contains a compound expressed by the following General Formula (A) and a compound expressed by the following General Formula (B)

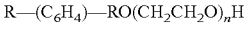

$$R—(C_6H_4)—RO(CH_2CH_2O)_nH \quad \text{General Formula (A)}$$

where R represents a straight or branched alkyl group with between 1 and 20 carbon atoms, and n represents an integer between 1 and 10,

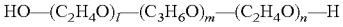

$$HO—(C_2H_4O)_l—(C_3H_6O)_m—(C_2H_4O)_n—H \quad \text{General Formula (B)}$$

where l represents an integer between 1 and 10, m represents an integer between 1 and 10, and n represents an integer between 1 and 10.

2. The electrolytic tin plating solution for chip components according to claim 1, wherein the concentration of the compound expressed by the aforementioned General Formula (A) and the concentration of the compound expressed by the aforementioned General Formula (B) in the tin plating solution is 0.05 g/L or higher and to less than 2 g/L.

3. The electrolytic tin plating solution for chip components according to claim 1, wherein the complexing agent is sodium gluconate.

4. The electrolytic tin plating solution for chip components according to claim 1, wherein the antioxidant is a salt of hydroquinonesulfonic acid.

5. A chip component tin plating method, comprising a step of electrolytic tin plating using the electrolytic tin plating solution of claim 1.

* * * * *